United States Patent [19]

Guiler

[11] Patent Number: 4,893,853

[45] Date of Patent: Jan. 16, 1990

[54] PADLOCK-TYPE SECURITY SEAL

[75] Inventor: Richard S. Guiler, Newton, N.J.

[73] Assignee: E. J. Brooks Company, Newark, N.J.

[21] Appl. No.: 300,895

[22] Filed: Jan. 24, 1989

[51] Int. Cl.[4] ..... E05B 39/02

[52] U.S. Cl. ..... 292/320; 24/704.1; 292/331

[58] Field of Search ..... 24/626, 704.1; 292/307 R, 318–321, 331

[56] References Cited

U.S. PATENT DOCUMENTS

| | | | |
|---|---|---|---|
| 1,014,252 | 1/1912 | Palmer | 292/320 |
| 1,132,970 | 3/1915 | Peyton | 292/307 R |
| 1,964,897 | 7/1934 | Wenk | 292/320 |
| 2,006,042 | 6/1935 | Dietze | 292/320 |
| 4,500,124 | 2/1985 | Swift | 292/318 |
| 4,733,893 | 3/1988 | Davis et al. | 292/320 |

FOREIGN PATENT DOCUMENTS

| | | | |
|---|---|---|---|
| 2043384 | 1/1979 | Fed. Rep. of Germany | 292/307 R |

*Primary Examiner*—Lloyd A. Gall

*Attorney, Agent, or Firm*—John G. Gilfillan, III

[57] ABSTRACT

A padlock-type security seal having tamper-indicating means to cause the shackle ends to break through and protrude from the walls of the seal body when serious attempts are made to remove the shackle. The seal includes a pair of slots each having a shoulder for engaging the shackle ends. When serious attempts are made to force the shackle from the seal, a ramp will engage the shackle ends and force them against the seal walls. With sufficient force applied to the shackle, the shackle ends will rupture the seal body.

10 Claims, 2 Drawing Sheets

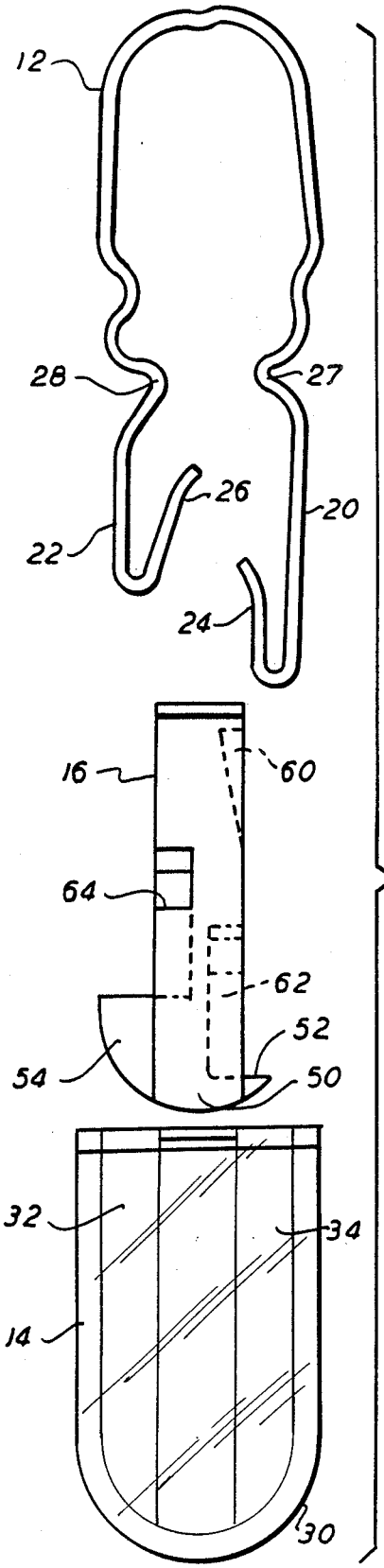
FIG. 1
FIG. 2
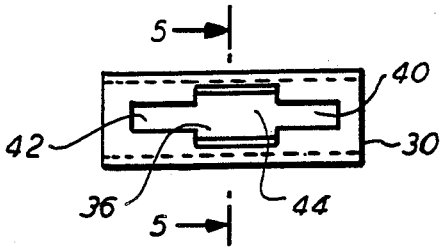
FIG. 3
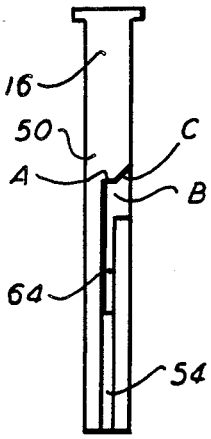
FIG. 4
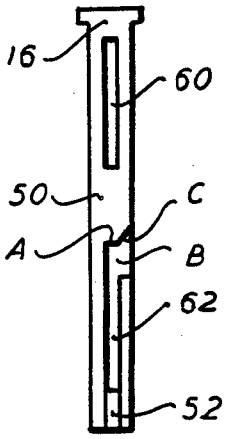
FIG. 5
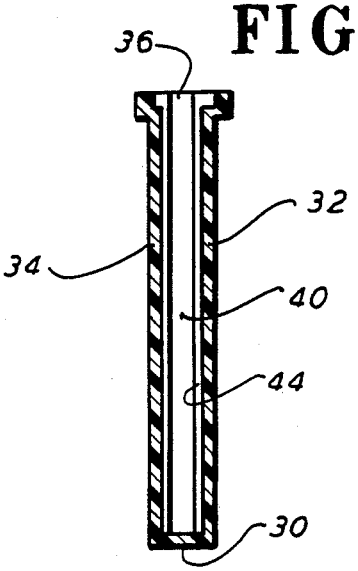

12
14
16
20
22
24
26
27
28
30
32
34
36
40
42
50
52
54
60
62
64
80
82
84
F

PADLOCK-TYPE SECURITY SEAL

BACKGROUND OF THE INVENTION

The present invention relates to seals and more particularly pertains to molded plastic security seals of the padlock-type.

Padlock-type security seals have found widespread use as a means for sealing electric meters, closures and the like. Such seals generally have a plastic body with a pair of apertures opening to one end of the body and a shackle formed of a piece of U-shaped wire having legs with reversely bent end portions. When the seal is put into use, the shackle legs are inserted into the body apertures for permanent retention therein such that the shackle must be severed or otherwise broken to open the seal. In addition to the usual locking mechanisms, e.g. a groove, bump or like structure that grips the shackle ends, most seals also include some form of tamper-indicating structure. Generally, tamper-indicating structures are designed such that any significant attempt to defeat or tamper with the seal will normally result in altering the seal in such a manner that the attempt will be readily detectable.

U.S. Pat. No. 4,687,240 discloses a typical padlock-type security seal having a tamper-indicating structure. In the 240 patent the molded body is formed from a relatively soft plastic material, such as polypropylene, and the shackle ends are made relatively sharp. When a tamperer attempts to pull the shackle from the body apertures in the 240 seal, the sharp shackle ends will penetrate the soft seal body and protrude therefrom irreversibly altering the original condition of the seal. Additionally, the piercing forces created by the shackle ends will result in causing the polypropylene body to turn a milky color, called blushing, in the areas penetrated by the shackle. While such seals have performed successfully under most conditions of operation, they have been unsatisfactory when used in situations where they are subjected to long periods of exposure to ultraviolet (UV) light, e.g. sunlight. It has been found, for example, that polypropylene subjected to UV for long periods will become unstable i.e., it will become brittle and eventually disintegrate into a powdery substance. As such, developers of security seals have turned to other plastic materials that are significantly more stable in sunlight. One popular material is acrylic, an inexpensive thermoplastic that is normally colorless and a good UV filter. However, because acrylic does not blush and is not sufficiently soft and pliable, many of the tamper-indicating structures used in polypropylene seals cannot be used in acrylic seals.

SUMMARY OF THE INVENTION

It is therefore an object of the present invention to provide an improved tamper-indicating structure that may be effectively employed in security seals made from a variety of plastic materials.

The general purpose of this invention is to provide a padlock-type security seal having tamper-indicating means to cause the shackle ends to break through or otherwise protrude from the walls of the seal body when attempts are made to remove the shackle. The exact nature of this invention, as well as other objects and advantages thereof, will be readily apparent from consideration of the following specification relating to the annexed drawings in which:

BRIEF DESCRIPTION OF THE DRAWINGS

FIG. 1 is an exploded, plan view of the preferred embodiment;

FIG. 2 is a top view of a portion of the device shown in FIG. 1;

FIGS. 3 and 4 are side elevation views of the device shown in FIG. 2;

FIG. 5 shows a section of a portion of the device taken on the line 5—5 of FIG. 2 looking in the direction of the arrows.

DESCRIPTION OF THE PREFERRED EMBODIMENT

Figures 6, 7, 8, 9:
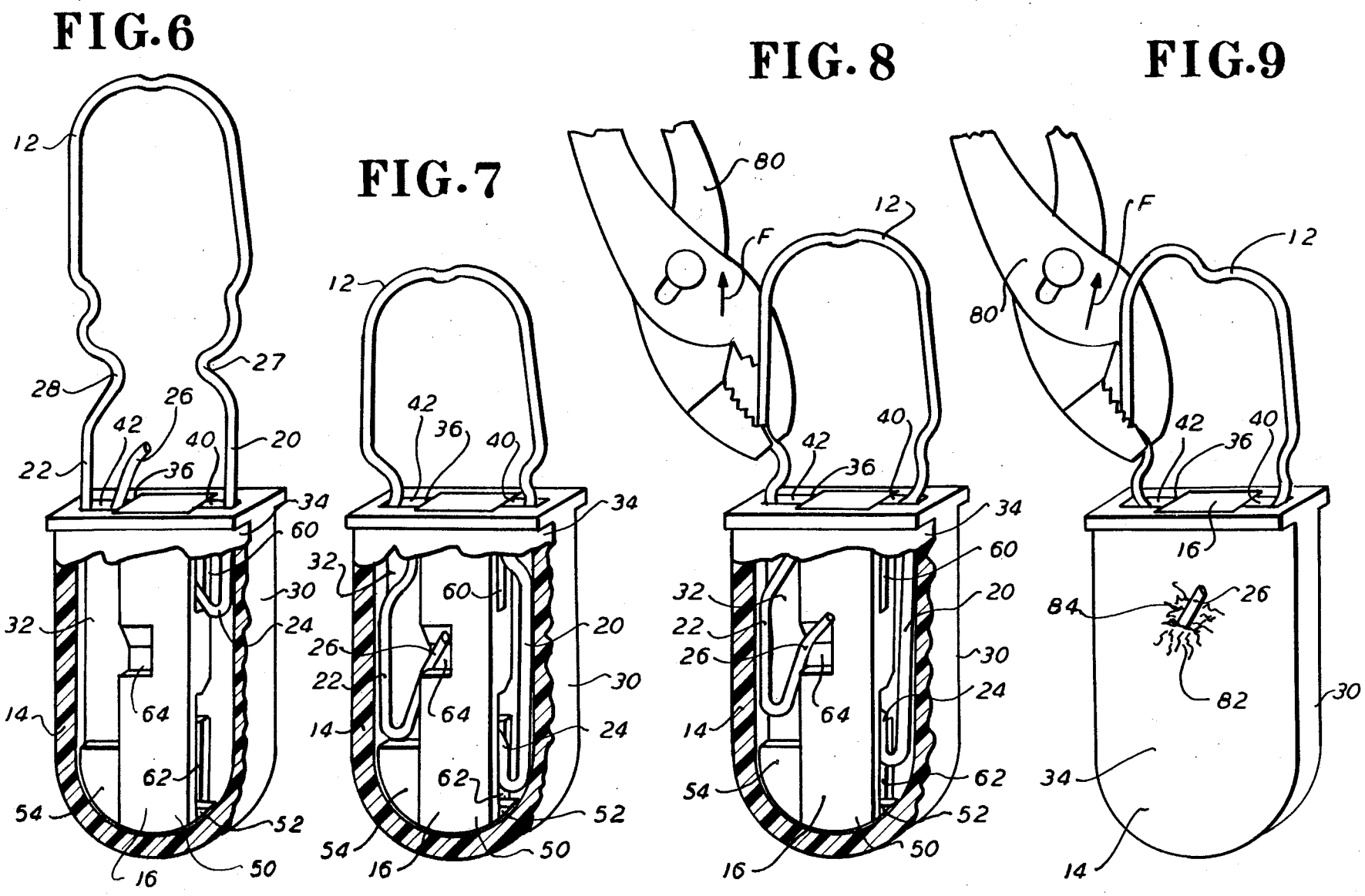
FIGS. 6–9 are perspective views of the device shown in FIG. 1 in various stages of use.

Referring now to the drawings there is shown a seal 10 composed of a shackle 12, a body 14 and a locking insert 16. Shackle 12, formed from resilient spring wire, is U-shaped with a long leg 20 and a short leg 22. The legs 20, 22 include reversely bent end portions 24, 26, respectively. The legs 20, 22 are also bent to form anti-picking bumps 27, 28, respectively.

The seal body 14 has a relatively thick, U-shaped wall 30 sandwiched between a pair of broad side walls 32, 34 at the edges thereof to form a narrow cup-shaped body having an opening 36 at one end thereof. The inside surfaces of the side walls 32, 34 are stepped to form two narrow side chambers 40, 42 and a wider central chamber 44 for receiving the insert 16.

Insert 16 has an elongated locking portion 50 with opposed stops 52, 54 formed at one end to extend from opposite sides thereof. Portion 50 is dimensioned to fit snugly in the central chamber 44. Stops 52 and 54 are narrower than portion 50 and are dimensioned to fit snugly in the chambers 40, 42, respectively. Stop 52 is relatively short and defines the bottom of chamber 40. Stop 54, longer than stop 52, defines the bottom of chamber 42. As such, the working section of chamber 42 is shorter than that of chamber 40. Finally, the central locking portion 50 has locking slots 60, 62, 64 formed thereon.

The insert 16 and body 14 may be molded separately from a variety of synthetic plastic materials. While acrylic is a preferred material for the reasons discussed above, those skilled in these arts will find other plastics to be suitable. The insert 16 and body 14 may even be made of dissimilar materials. Because acrylic is a good IV filter, the insert 16 neednot be made of acrylic to obtain the advantages of stability, as discussed above, as long as the body 14 is acrylic.

After molding, the insert 16 and body 14 are assembled by first sliding the insert 16, with stops 52, 54 first, into the opening 36. The insert 16 is then fixed in the body 14 by conventional methods, such as ultrasonic welding of the inside surfaces of chamber 44 to the surface of portion 50 on insert 16.

The locking slot 60 is formed on the side of portion 50 that borders chamber 40 and is located near the opening 36. As shown in FIG. 6, the shackle 12 is initially assembled on the seal 10 with the long leg 20 inserted into chamber 40 and the short leg 22 in chamber 42. At this stage of assembly, the reversely bent end portion 24 is contained in slot 60, for permanently coupling the shackle 12 to the seal 10, while the reversely bent end portion 26 is only partially received in chamber 42. It is in this condition that the seal 10 is customarily delivered to the customer.

The seal 10 is put into use by first flexing the resilient shackle 12 to free the short leg 22 from chamber 42. The long leg 20 remains locked in slot 60. The leg 22 is then threaded through a structure (not shown) to be sealed, such as a lock on an electric meter, and then reinserted into the chamber 42. Finally, the shackle 12 is then forced further into the seal body 14 until the reversely bent end portions 24, 26 abut stops 52, 54, respectively.

While inserting the shackle 12 into the chambers 40, 42, the reversely bent end portions 24, 26 will snap into the slots 62, 64, respectively (FIG. 7). At this point, the seal 10 is in its locked position. Locking slots 62, 64, identical in shape, each have a locking shoulder (A), an opening (B) and a ramp (C) extending therebetween. The ramp (C) tapers from shoulder (A) to the inside surface of body 14 in chamber 44 in a direction toward the opening 36.

Slots 62, 64 are dimensioned to retain the reversely bent end portions 24, 26, respectively, with the ends thereof located below shoulders (A). Under normal use, the shoulders (A) will prevent the shackle 12 from moving in a direction up towards opening 36. However, if a sufficient force is applied to shackle 12, e.g. the leg 22 is gripped by pliers 80 and forced in the direction shown by arrow (F) in FIGS. 8, 9, the end of the reversely bent end portion 22 or 26 or both will disengage from shoulder (A) and be forced against the inside surface of the broad wall 32 or 34 or both due to the camming action of ramp (C) (FIG. 8). It is noted that the wall thickness of the body 14 is narrower in the area adjacent the openings (B). As such, those portions of the broad walls 32, 34 adjacent openings (B) are more susceptible to damage than the other locations. Also, in the position depicted in FIG. 8, there will be a significant concentration of forces and pressures exerted by portions 24, 26 in a direction perpendicular to the plane of the walls 32, 34 due to the camming action of the ramp (C).

As depicted in FIG. 9, the end portion 26 will alter the outside surface of seal 10 in two significant ways to indicate tampering. First, under sufficient pressure from end portion 26, the acrylic material of wall 34 will craze and cause noticeable cracks 82 on the outside surface thereof. Second, as the force (F) is increased, the acrylic material will eventually rupture, causing the end portion 26 to be exposed through an opening 84 (FIG. 9). Each of these conditions each will provide an irreversible, visual indication of tampering.

Obviously many modifications and variations of the present invention are possible in the light of the above teachings. For example, those skilled in these arts will appreciate that the present tamper-indicating mechanism will work equally as well when the body 14 is made of polypropylene and the shackle ends are sufficiently sharpened. In that case, the ramp (C) will cam the sharpened ends toward the walls 32, 34 causing blushing as the ends penetrate the walls 32, 34. It is therefore to be understood that, within the scope of the appended claims, the invention may be practiced otherwise than as specifically described.

What is claimed is:

1. A security seal comprising:

a shackle having at least one leg with a resilient locking element thereon;

a seal body having a chamber therein and an opening in one side thereof contiguous with said chamber;

a locking insert mounted in said seal body;

said insert having a slot in at least one wall thereof with an opening contiguous with said chamber; and means in said slot for engaging said locking element and retaining said shackle leg in said chamber and for forcing said element against a predetermined portion of said body when a sufficient force is applied to said shackle.

2. A security seal according to claim 1 wherein said means forces said element against said body at an angle with respect to said force applied to said shackle.

3. A security seal according to claim 2 wherein said predetermined portion of said body is rupturable under said force applied thereto.

4. A security seal according to claim 1 wherein said means in said slot includes a shoulder engaging said element.

5. A security seal comprising:

a shackle having at least one leg with a resilient locking element thereon;

a seal body having a chamber therein and an opening in one side thereof contiguous with said chamber;

a locking insert mounted in said seal body;

said insert having a slot in at least one wall thereof with an opening contiguous with said chamber;

means in said slot for engaging said locking element and retaining said shackle leg in said chamber and for forcing said element against a predetermined portion of said body when a sufficient force is applied to said shackle;

wherein said means forces said element against said body at an angle with respect to said force applied to said shackle;

wherein said predetermined portion of said body is rupturable under said force applied thereto;

wherein said means in said slot includes a shoulder engaging said element; and wherein said means in said slot further includes a camming surface extending between said shoulder and said predetermined portion of said body.

6. A security seal comprising:

a U-shaped resilient shackle having first and second legs each having a reversely bent end portion;

a hollow seal body having an opening in one side thereof;

an insert mounted in the hollow interior of said hollow seal body;

said insert and said hollow interior of said hollow seal body defining elongated first and second chambers contiguous with said opening:

said insert having first and second slots on opposed sides thereof;

each said first and said second slot having an opening therein contiguous with a different one of said elongated chambers; and means in each said first and second slot for engaging said end portions and retaining said shackle leg in said chamber and for forcing each said end portion against a predetermined portion of said body when a sufficient force is applied to said shackle.

7. A security seal according to claim 6 wherein each said means forces each said end portion against said body at an angle with respect to said force applied to said shackle.

8. A security seal according to claim 7 wherein said prdetermined portions of said body are rupturable under said force applied thereto.

9. A security seal according to claim 6 wherein each said means in said slots includes a shoulder engaging said end portion.

10. A security seal comprising:

a U-shaped resilient shackle having first and second legs each having a reversely bent end portion;

a hollow seal body having an opening in one side thereof;

an insert mounted in the hollow interior of said hollow seal body;

said insert and said hollow interior of said hollow seal body defining elongated first and second chambers contiguous with said opening;

said insert having first and second slots on opposed sides thereof;

each said first and said second slot having an opening therein contiguous with a different one of said elongated chambers;

means in each said first and second slot for engaging said end portions and retaining said shackle leg in said chamber and for forcing each said end portion against a predetermined portion of said body when a sufficient force is applied to said shackle wherein each said means forces each said end portion against said body at an angle with respect to said force applied to said shackle;

wherein said prdetermined portions of said body are rupturable under said force applied thereto;

wherein each said means in said slots includes a shoulder engaging said end portion; and wherein each said means in said slot further includes a camming surface extending between said shoulder and said predetermined portions of said body.

* * * * *